US010631582B2

(12) United States Patent
Brault

(10) Patent No.: US 10,631,582 B2
(45) Date of Patent: Apr. 28, 2020

(54) UNDERGARMENT FOR CARRYING A BABY SKIN-TO-SKIN

(71) Applicant: Vivianne Brault, Québec (CA)

(72) Inventor: Vivianne Brault, Québec (CA)

( * ) Notice: Subject to any disclaimer, the term of this patent is extended or adjusted under 35 U.S.C. 154(b) by 110 days.

(21) Appl. No.: 15/742,605

(22) PCT Filed: Nov. 3, 2015

(86) PCT No.: PCT/CA2015/051124

§ 371 (c)(1),
(2) Date: Jan. 8, 2018

(87) PCT Pub. No.: WO2017/008139

PCT Pub. Date: Jan. 19, 2017

(65) Prior Publication Data

US 2018/0184728 A1 Jul. 5, 2018

(30) Foreign Application Priority Data

Jul. 10, 2015 (CA) ..... 2896575

(51) Int. Cl.

| | |
|---|---|
| ***A47D 13/02*** | (2006.01) |
| ***A41D 1/215*** | (2018.01) |
| ***A41B 13/06*** | (2006.01) |
| ***A41B 9/06*** | (2006.01) |
| ***A41B 9/16*** | (2006.01) |

(Continued)

(52) U.S. Cl.

CPC ..... *A41D 1/215* (2018.01); *A41B 9/06* (2013.01); *A41B 9/16* (2013.01); *A41B 13/06* (2013.01); *A41D 15/00* (2013.01); *A41D 27/24* (2013.01); *A47D 13/02* (2013.01); *A47D 13/025* (2013.01); *A41B 2300/35* (2013.01); *A41D 2400/482* (2013.01)

(58) Field of Classification Search

CPC ..... A47D 13/025; A41D 1/215; A41D 1/20; A41D 13/02; A41D 2400/482; A41D 1/21

See application file for complete search history.

(56) References Cited

U.S. PATENT DOCUMENTS 5,946,725 A 9/1999 Shatzkin et al.
6,065,655 A 5/2000 Parewick (Continued)

FOREIGN PATENT DOCUMENTS

GB 2550613 A * 11/2017 ..... A47D 13/025

*Primary Examiner* — Tajash D Patel

(74) *Attorney, Agent, or Firm* — Benoit & Cote, Inc.; C. Marc Benoit

(57) ABSTRACT

In order to increase the effectiveness and popularity of the kangaroo care method (skin-to-skin and breastfeeding with newborn baby) in developing countries, especially in order to save and protect weakened babies, the present invention relates to a straightforward, inexpensive solution for facilitating and encouraging this practice; a light, soft, comfortable, flexible garment that allows a baby to be held in a skin-to-skin manner for a long period of time, safely and leaving the hands free, thanks to a built-in, seamless seat, inter alia. As the garment can be used as an undergarment and is one-size-fits-all, it is easier for humanitarian and medical organizations to distribute, and more acceptable according to the cultural and religious criteria governing dress in most developing countries.

22 Claims, 11 Drawing Sheets

(51) Int. Cl.
*A41D 15/00* (2006.01)
*A41D 27/24* (2006.01)

(56) References Cited

U.S. PATENT DOCUMENTS

| | | | | |
|---|---|---|---|---|
| 6,343,727 | B1 * | 2/2002 | Leach | A47D 13/02 2/102 |
| 9,402,430 | B2 * | 8/2016 | Jensen | A41D 1/22 |
| 2011/0296581 | A1 * | 12/2011 | Armstrong | A41D 1/215 2/104 |
| 2012/0234877 | A1 | 9/2012 | Hiniduma-Lokuge | |
| 2013/0168422 | A1 | 7/2013 | Carbonell | |
| 2013/0200116 | A1 * | 8/2013 | Arvan | A47D 13/025 224/158 |
| 2013/0291279 | A1 * | 11/2013 | Jensen | A41D 1/22 2/69 |
| 2014/0084031 | A1 | 3/2014 | Bowden | |
| 2014/0283277 | A1 | 9/2014 | Wilhelm | |
| 2014/0284362 | A1 | 9/2014 | Halverstadt | |

* cited by examiner

Fig. 1)
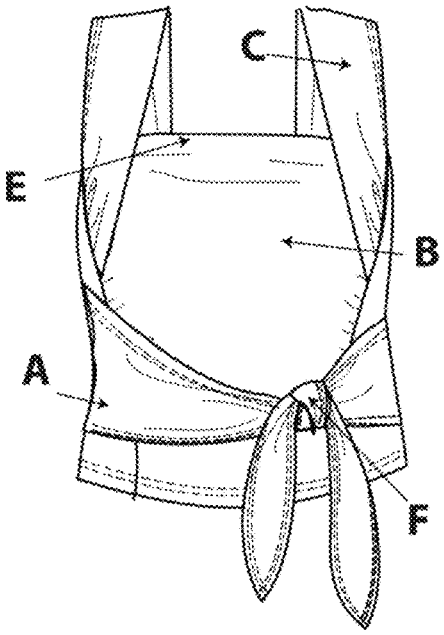
Fig. 2)
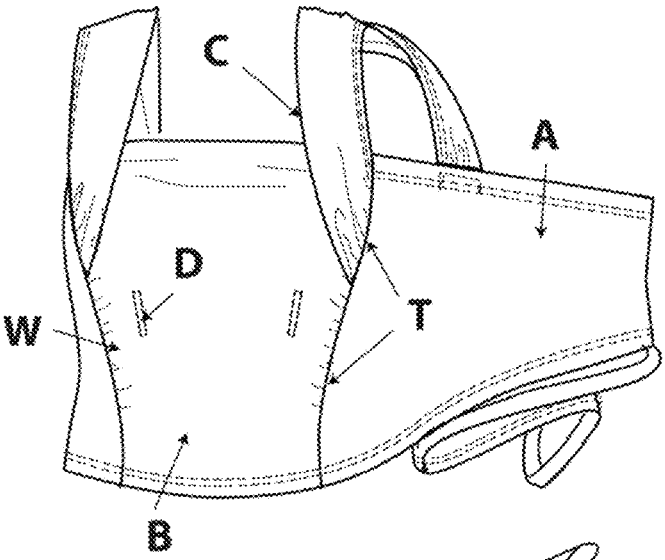
Fig. 3)
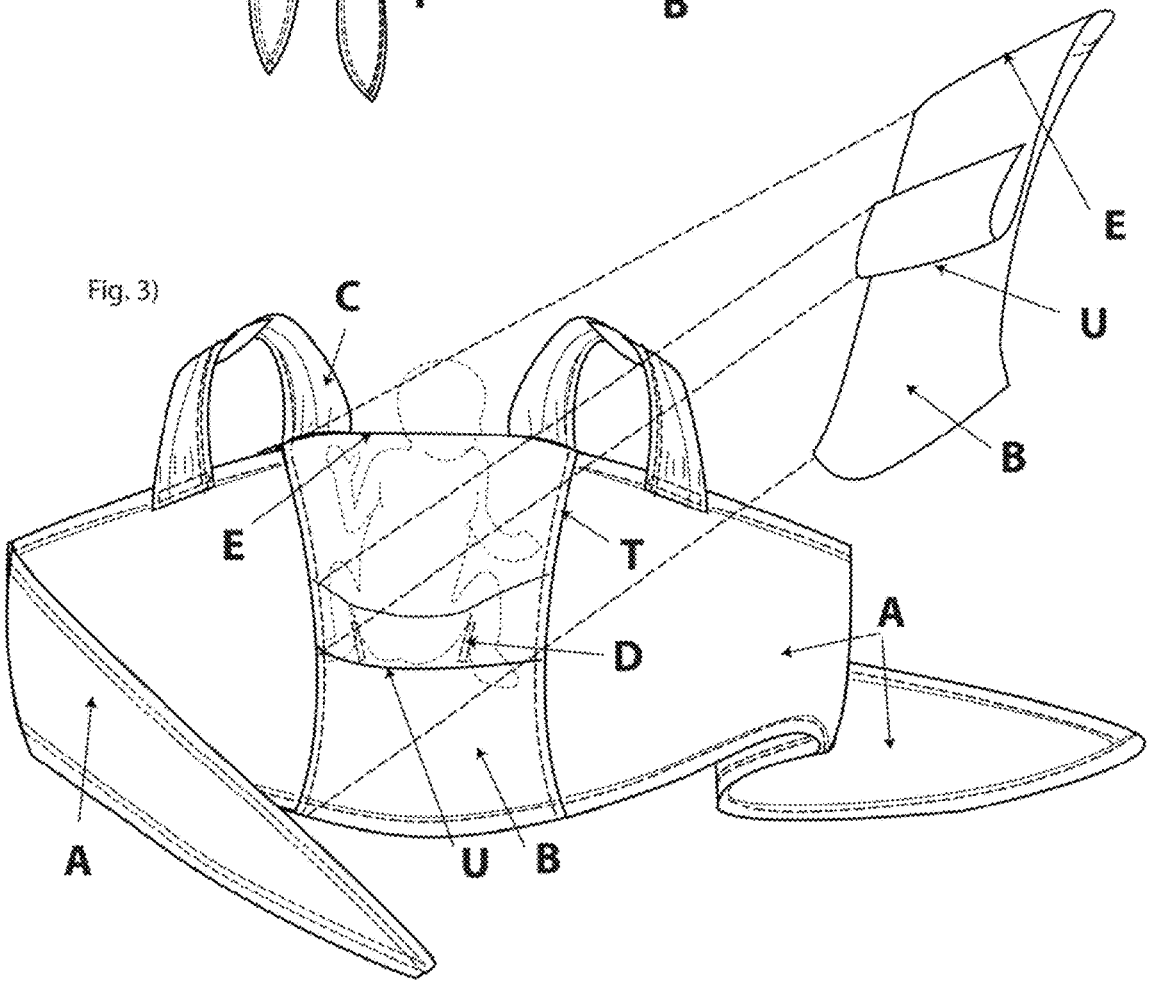

Fig. 4)
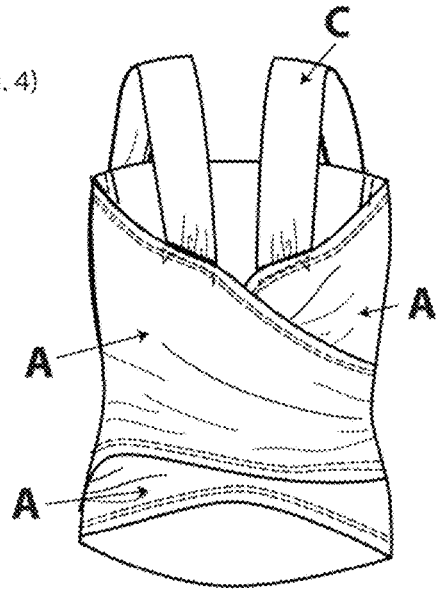
Fig. 5)
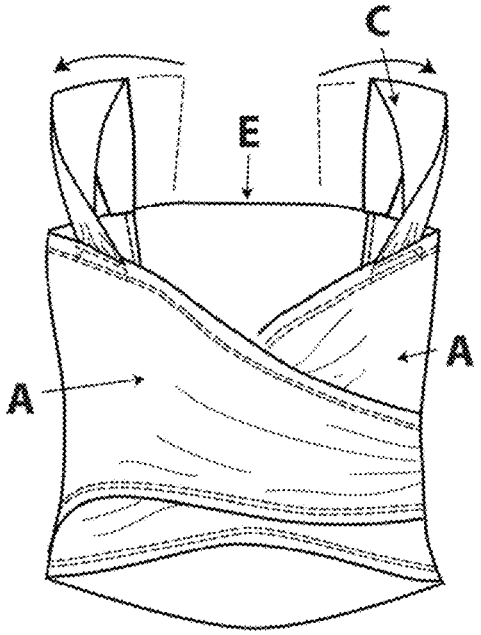
Fig. 6)
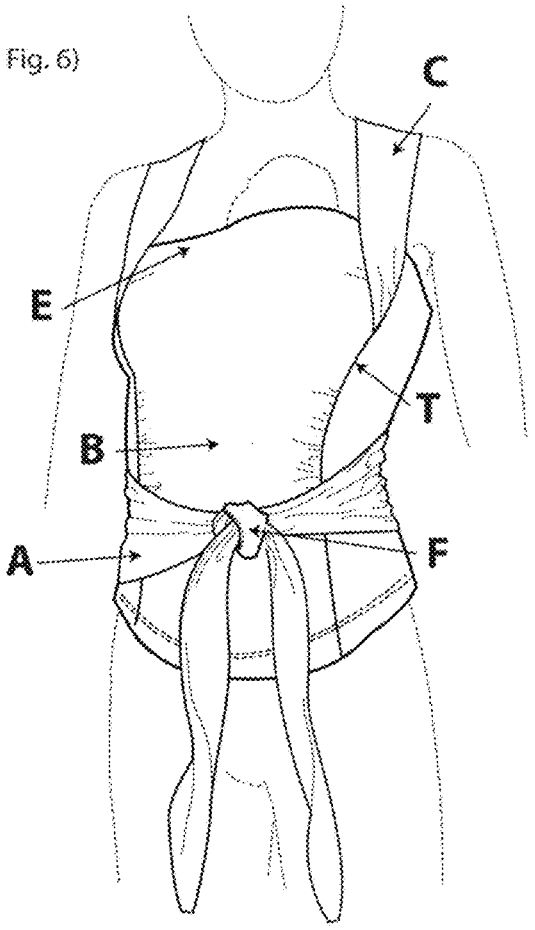
Fig. 7)
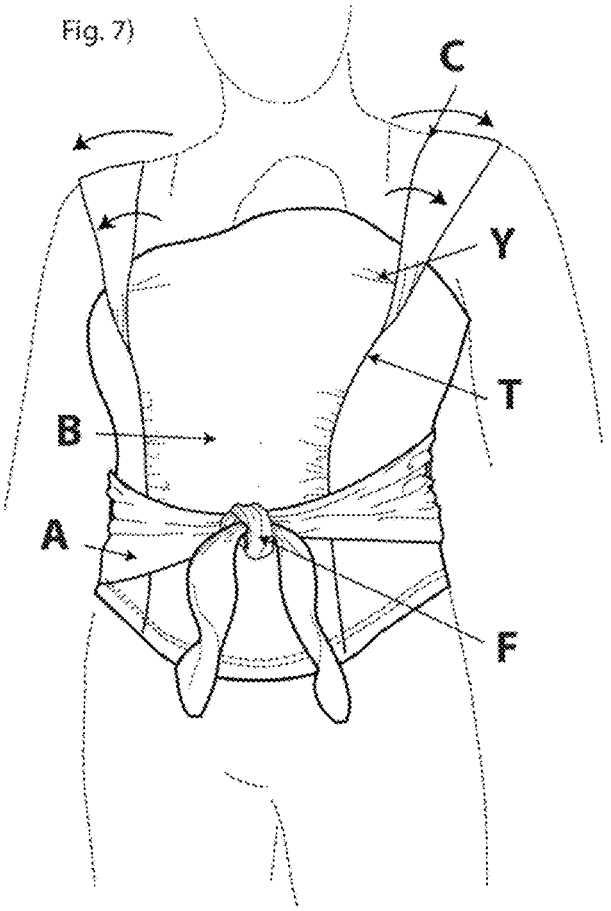

Fig. 8)
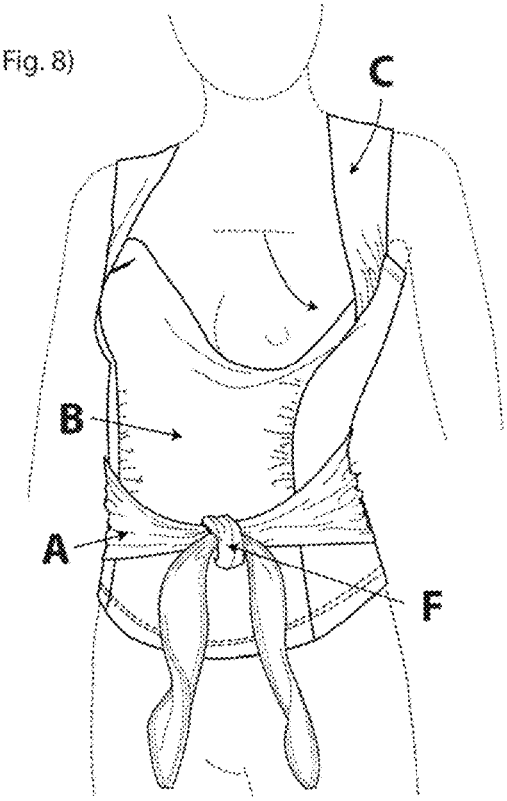
Fig. 9)
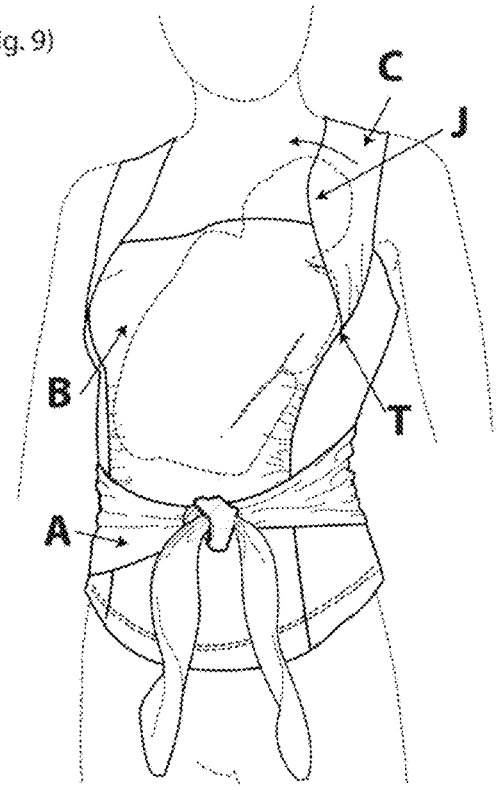
Fig. 10)
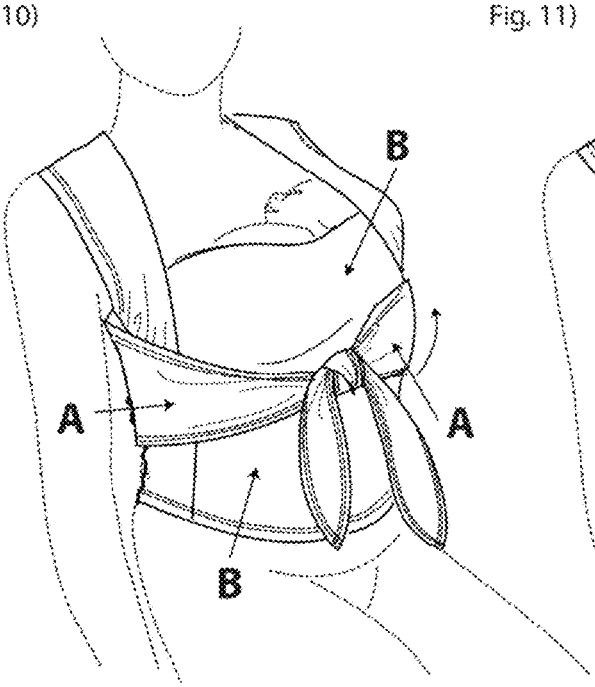
Fig. 11)
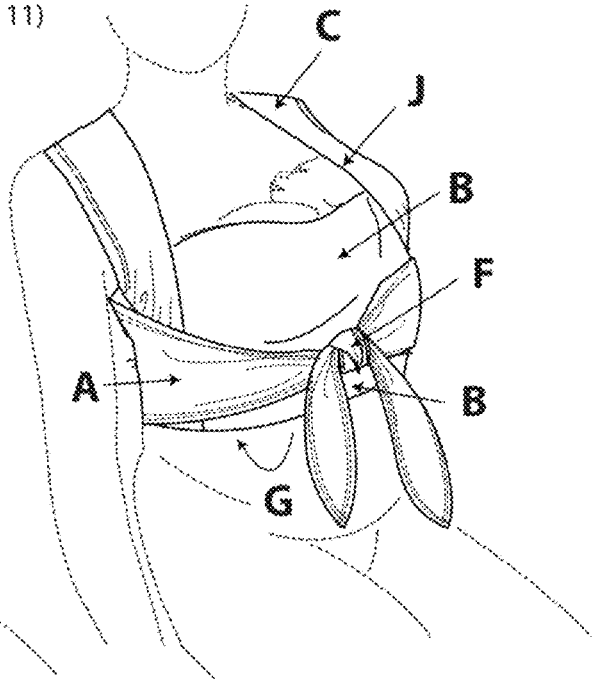

Fig. 12)
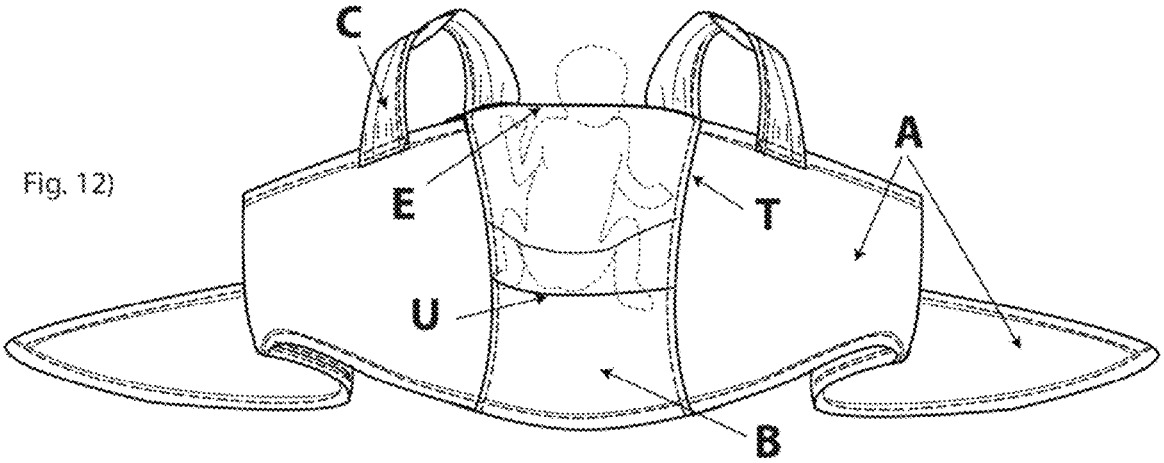
Fig. 13)
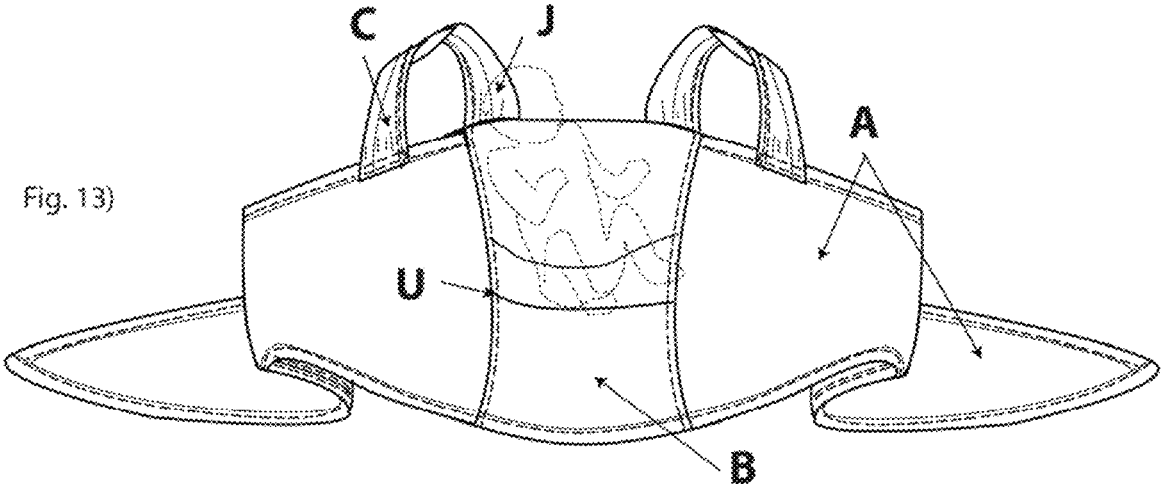
Fig. 14)
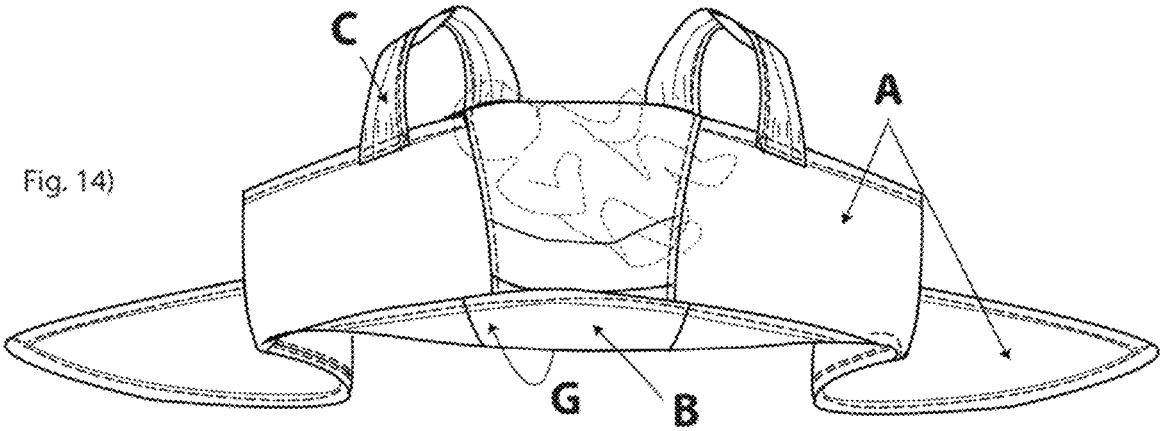

Fig. 15)
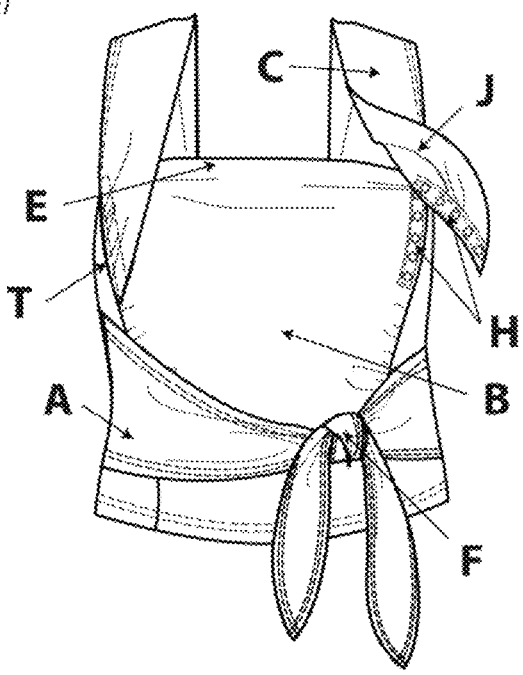
Fig. 16)
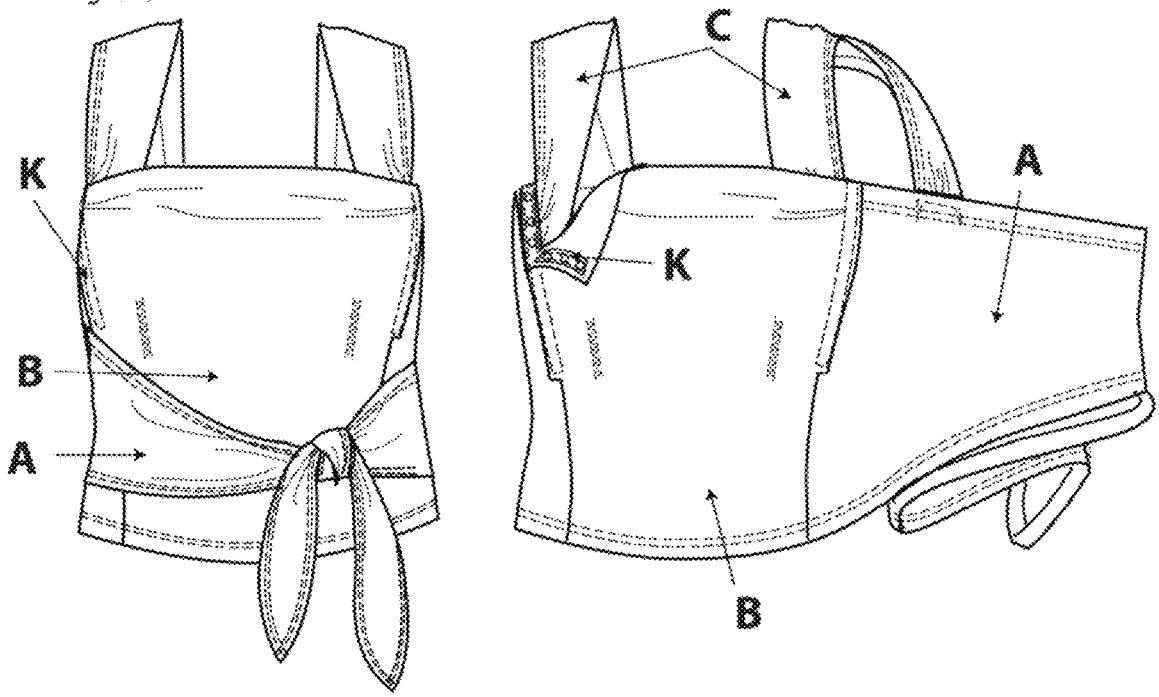

Fig. 17)
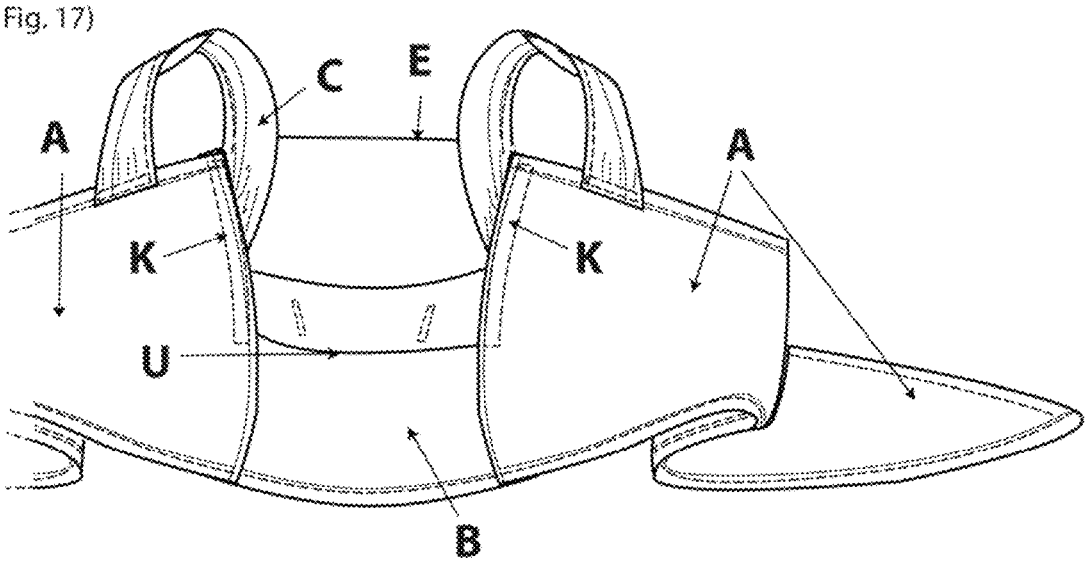
Fig. 18)
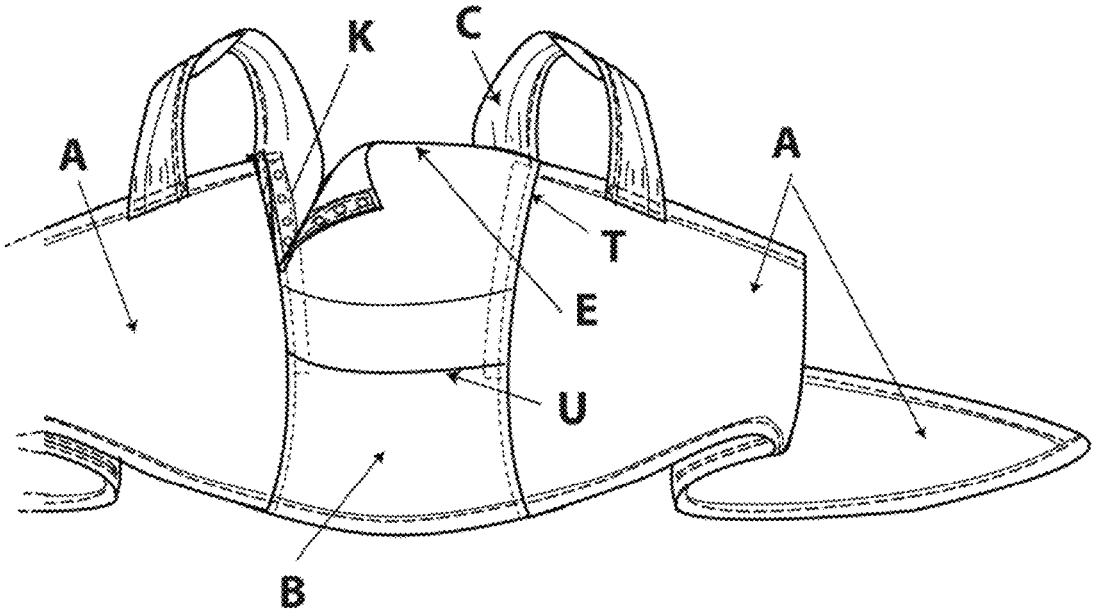

Fig. 19)
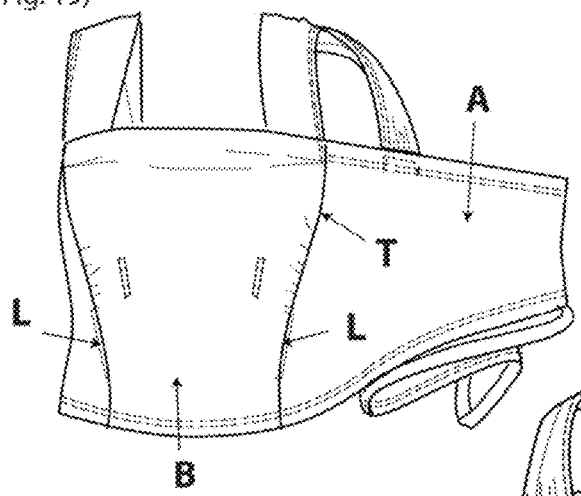
Fig. 20)
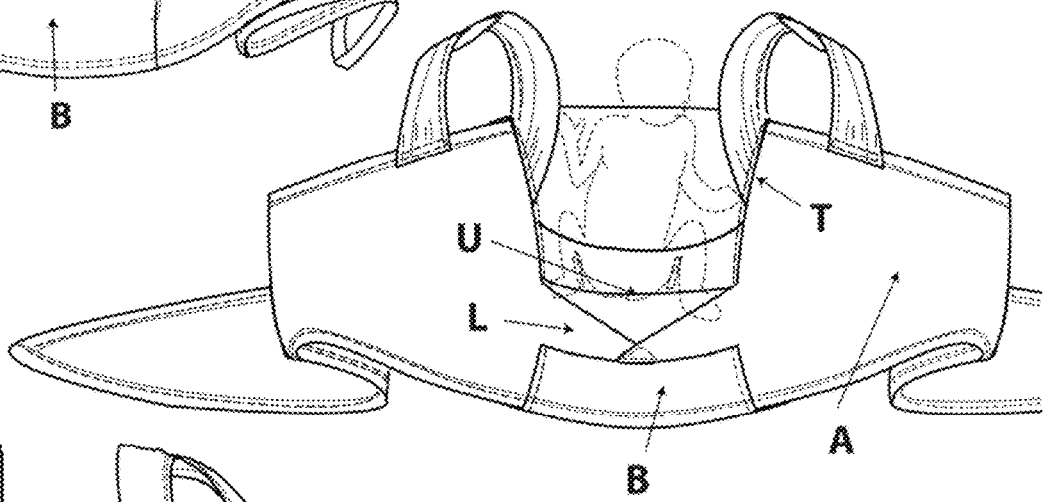
Fig. 21)
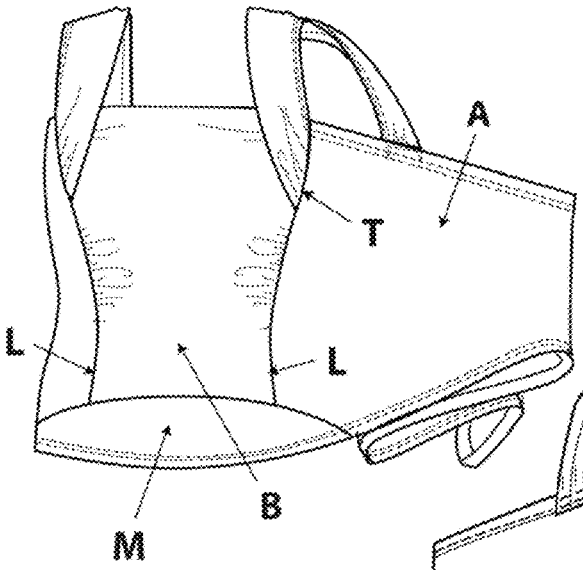
Fig. 22)
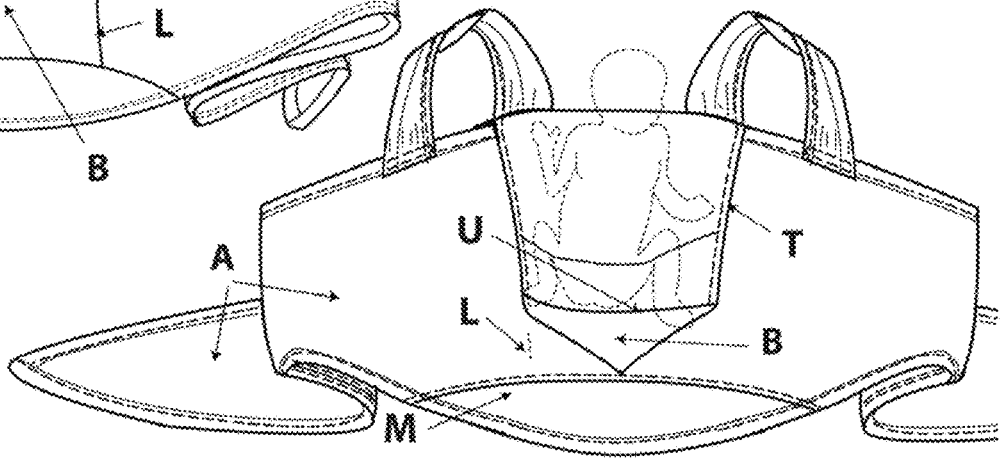

Fig. 23)
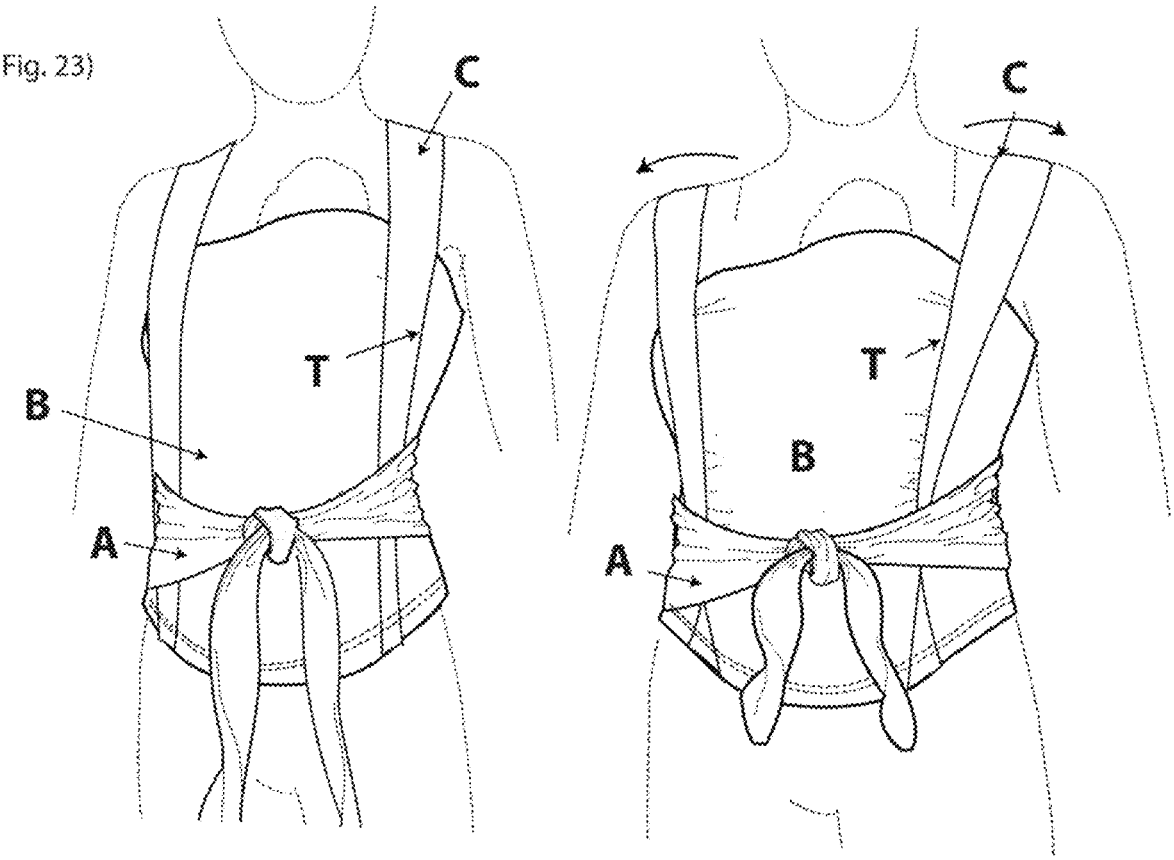
Fig. 24)
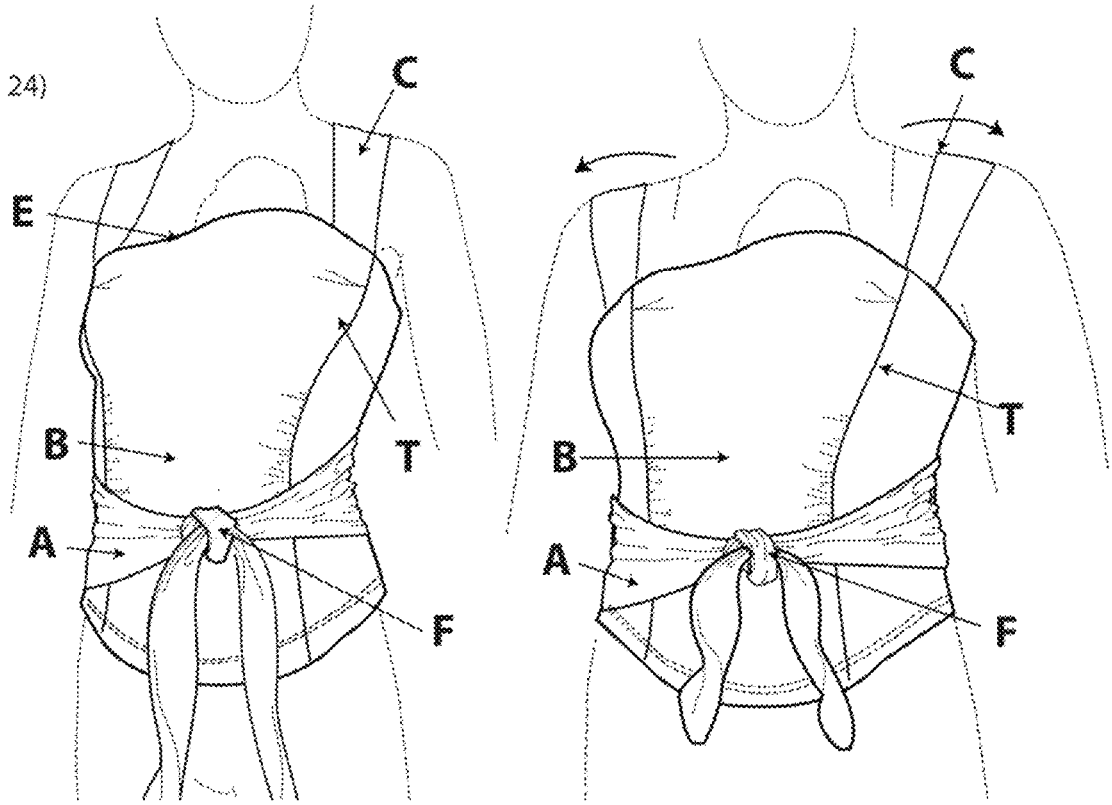

Fig. 25)
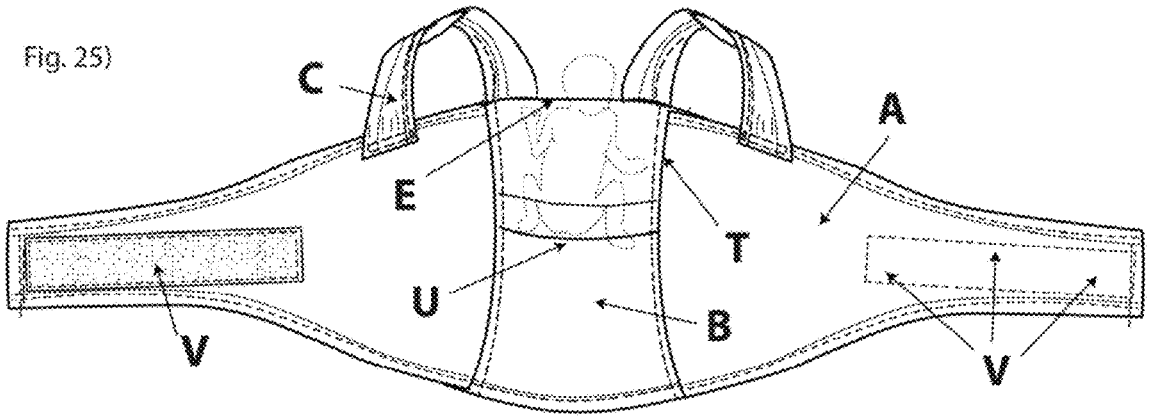
Fig. 26)
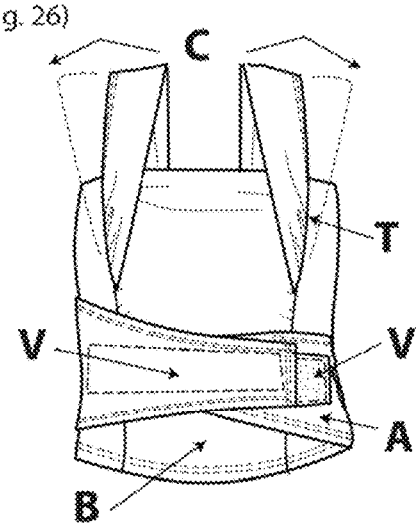
Fig. 27)
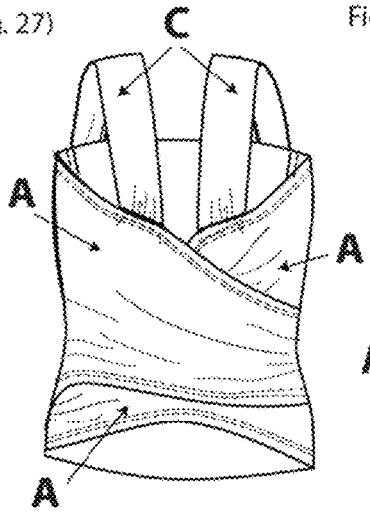
Fig. 28)
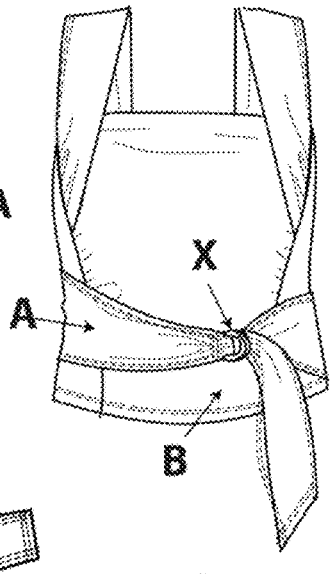
Fig. 29)
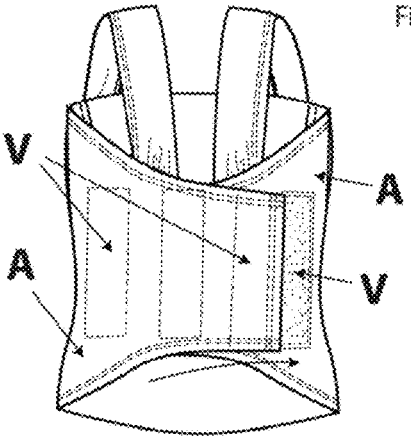
Fig. 30)
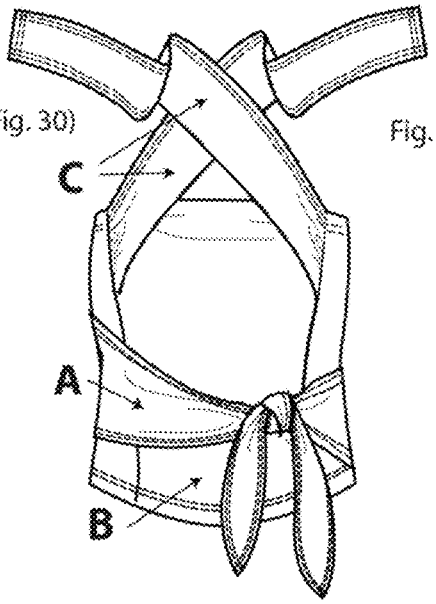
Fig. 31)
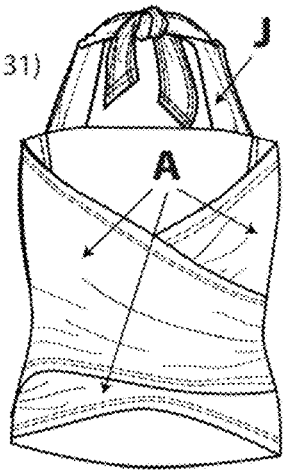

Fig. 32)
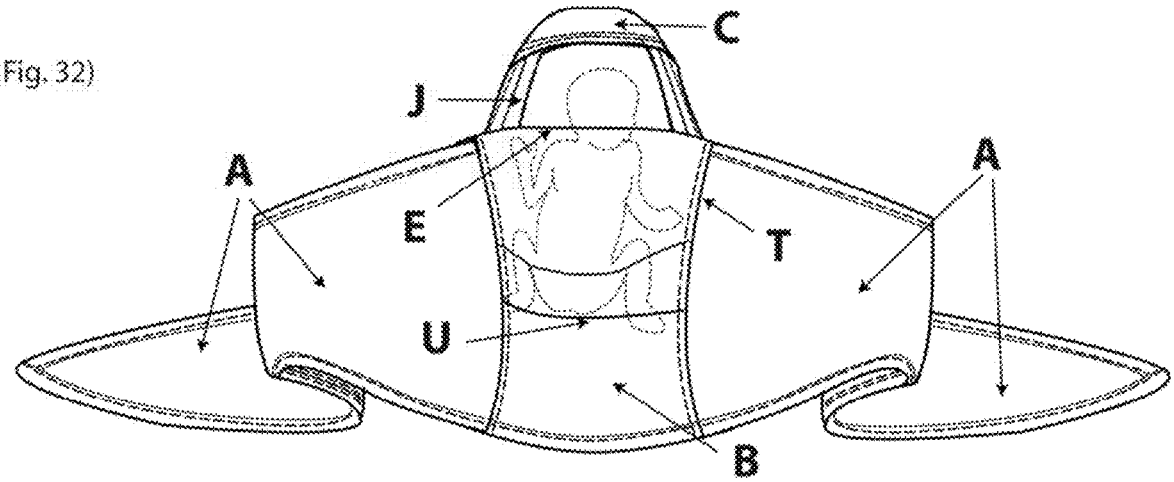
Fig. 33)
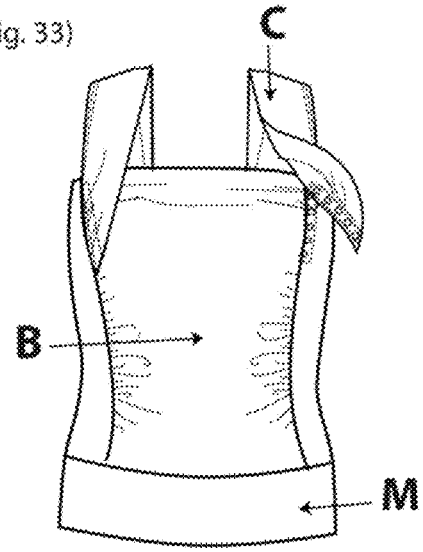
Fig. 34)
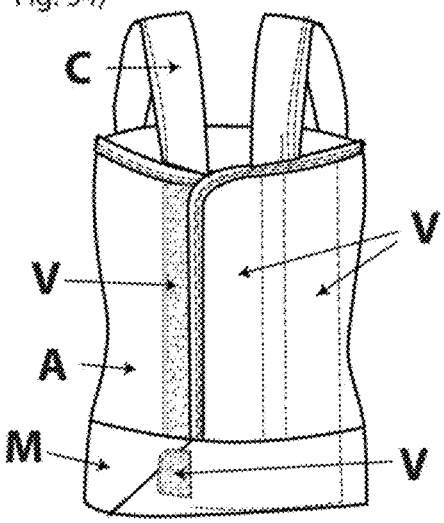
Fig. 35)
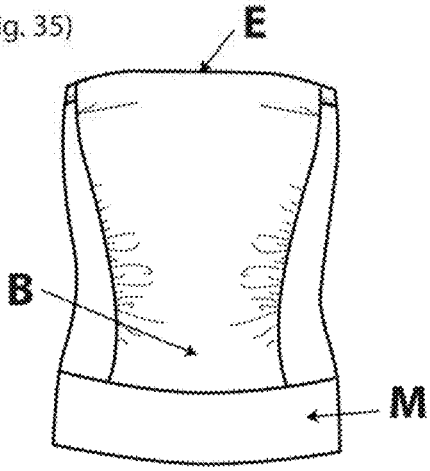
Fig. 36)
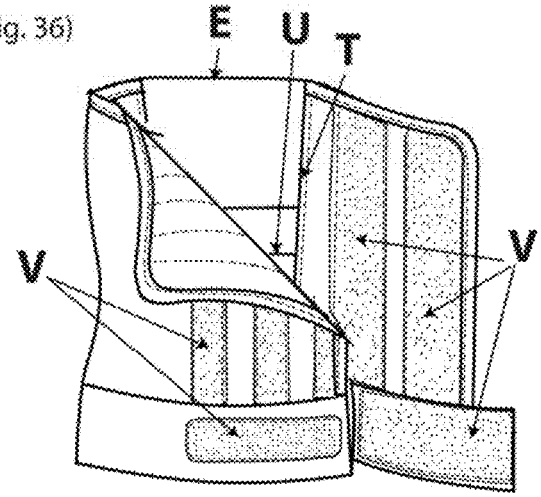

Fig. 37)
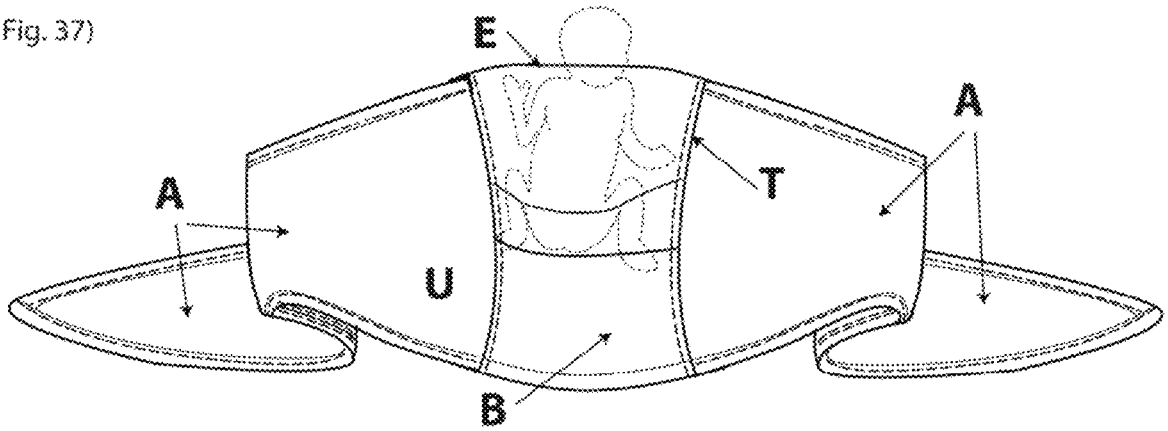
Fig. 38)
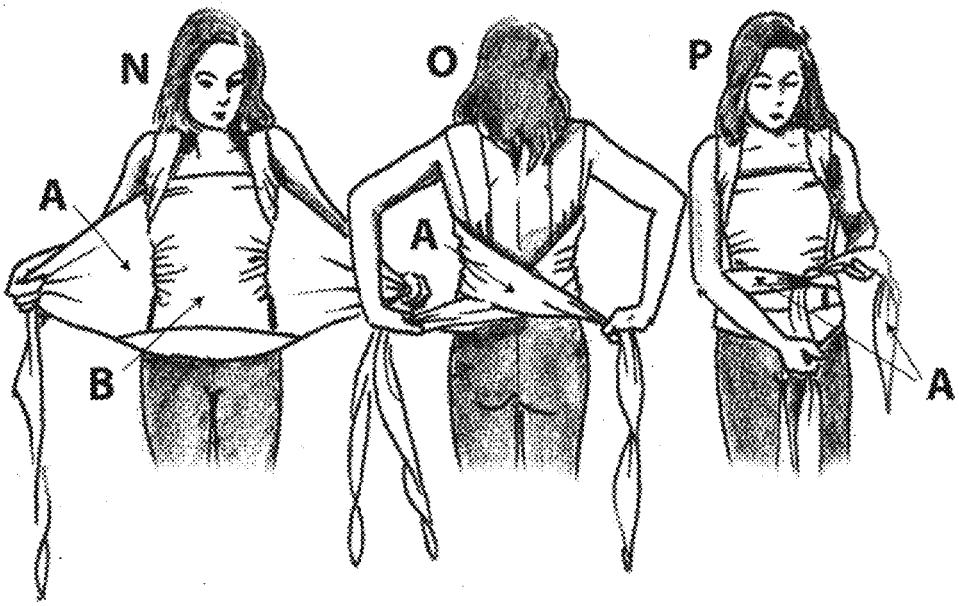
Fig. 39)
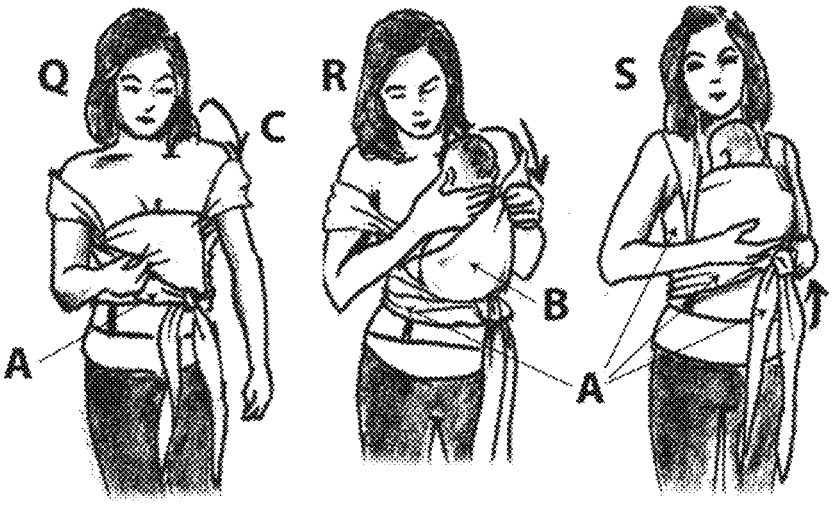

UNDERGARMENT FOR CARRYING A BABY SKIN-TO-SKIN

FIELD OF THE INVENTION

General Characteristics

The present invention relates to the need for integral skin-to-skin babywear over a long period of time, in a safe and hands-free manner, comfortable even in hot weather, and the joint need of breastfeeding, as prescribed by the Kangaroo Care Method. It is known that the Kangaroo Mother Care (KMC), which includes skin-to-skin and breastfeeding, is intended to protect and/or save the lives of premature, low birth weight, or weakened babies, especially in developing countries, where humanitarian workers and medical staff often do not have access to incubators to stabilize their temperature. The present invention also relates to the need to have an easy-to-use, easy-to-manage inventory product, accessible and inexpensive for humanitarian and medical organizations, and, if necessary, to increase skin-to-skin utilization among populations reluctant to abandon their traditional clothing.

Background of the Invention

Up to the present invention, to practice skin-to-skin over a long period of time (which can sometimes be required up to 22 hours a day for several weeks, for the care of a baby premature, low weight or weakened), the parent had to hold the baby in a semi-sitting position, with the help of a band-tube, a piece of cloth, a blanket. To get a hand-free skin-to-skin holding, wearer had to use a baby carrier that uncovers parent's body, a wrap or a skin-to-skin t-shirt. To stabilize baby's temperature, it was also possible to use a portable infant warmer. These solutions are difficult to use over a long period of time, often too hot, too uncomfortable, unsafe if hand-free, do not allow the parent to go outside and continue his/her occupations, are difficult to manage for humanitarian workers, or too costly in manufacturing or transport. They are often abandoned too quickly by the parent since they do not match cultural and religious criteria of clothing in their area.

The inventor had created a skin-to-skin baby carrier bodice (Canadian patent application #2,825,577) with infant support inside front panel but it does not support the upper back of the baby enough, the vertical support is insufficient for use in hand-free upright and extended position. The edge seam at the top of the garment could be irritate the very delicate skin of a premature baby.

SUMMARY OF THE INVENTION the invention is a "one-size-fits-all" garment, lightweight and comfortable in warm weather, which supports hand-free a newborn or low weight baby continuously for several hours a day for several weeks. The garment gives support and warmth only to the baby, thanks to a front support panel that folds and folds again so it forms a seamless support seat for the baby without rigid friction point on its fragile skin, and two layers of fabric at his back, neck and buttocks to prevent heat loss. Wide and flexible shoulder straps, integrated to semi-lateral support seams, distribute the weight properly and securely for optimal comfort during long-term baby wearing. By pivoting on itself, these straps can be worn towards the wearer's neck from the pivot of the semi-lateral seam for the small wearer or towards the outer shoulder, for the larger wearer. These shoulder straps, as well as the front panel, can be detachable or adjustable to allow different medical procedures or to further facilitate breastfeeding. It can easily be used as an undergarment, so be worn under other clothing with comfort, maximizing the long-term use of the parent who is reluctant due to cultural or religious clothing restrictions and also for wearing at the hospital under a robe or hospital gown. This garment can be worn skin-to-skin with baby in a semi-laying position, sitting or standing, making it versatile and easy to use in any situation. This garment has the advantage of being manufactured in many fabrics available on the market and easy to obtain, which makes it more accessible and less expensive for humanitarian use and also gives the possibility of manufacturing in a disadvantaged environment to help some communities. Its lightness and simplicity makes it inexpensive to handle, to transport, and the lack of size management in inventory and great ease of use makes it a useful product for humanitarian and medical organizations that are concerned about saving babies lives, but also to help people with reduced mobility or with intravenous tubing to benefit from the precious skin-to-skin contact with their baby.

BRIEF DESCRIPTION OF THE DRAWINGS

FIG. 1) shows a front and side view of the closed and attached garment

FIG. 2) shows a front and flat view of the garment closed on the left and open on the right with folded side panel.

FIG. 3) shows a flat inside view of the open garment and folded-back panels, with a view of the baby's vertical position inside and detail of how the panel is folded inside.

FIG. 4) shows a flat view of the back of the closed and attached garment in 'small size' position FIG. 5) shows a flat view of the back of the closed and attached garment in "large size" position FIG. 6) shows a semi-profile front view of the closed and attached garment, with a baby inside, on a "small size" person.

FIG. 7) shows a semi-profile front view of the closed and attached garment, with a baby inside, on a "large size" person.

FIG. 8) shows a semi-profile front view of the closed and attached garment, with the front panel pulled down for breastfeeding.

FIG. 9) shows a semi-profile front view of the closed and attached garment, with a view of the vertical position but slightly leaning of the baby inside, with head held by the shoulder strap.

FIG. 10) shows a semi-profile front view of the closed and attached garment, with a view of the horizontal position of the baby inside, called "cradle position", with head held by the shoulder strap and lifted front tie for higher level support.

FIG. 11) shows a semi-profile front view of the closed and attached garment, with a view of the horizontal position of the baby inside, called "cradle position", with head held by the shoulder strap and lifted front tie for higher level support, lower part of front is folded to clear wearer's belly.

FIG. 12) shows a flat inside view of the open garment with folded-back panels, with view of the vertical position of the baby sitting into inside pocket.

FIG. 13) shows a flat inside view of the open garment with folded-back panels, with a view of the slightly leaning vertical position of the baby who sits into inside pocket and head supported by the flexible edge of the shoulder strap.

FIG. 14) shows a flat inside view of the open garment with folded-back panels, with baby's view in a horizontal position with the head raised, called the "cradle position", lower part of front is folded inwards to clear wearer's belly.

FIG. 15) shows a front and flat view of the closed and attached garment, with a semi-detached shoulder strap on the right FIG. 16) shows a front and flat view of the garment, on the left in closed and fastened position and on the right in closed and semi-open position on the right side, with semi-open front panel at the semi-lateral seam at left.

FIG. 17) shows a flat inside view of the open garment with folded-back panels, with detachable front panel and shoulder straps sewn to inside side panels. Partial view of the left side since it is a reflection of the right side.

FIG. 18) shows a flat inside view of the open garment with folded-back panels, with detachable front panel and shoulder straps sewn to outside side panels. Partial view of the left side since it is a reflection of the right side.

FIG. 19) shows a front and flat view of closed garment on left side and open on right side, with openings that gives access to the baby, into the semi-lateral seam, under the seat.

FIG. 20) shows a flat view of inside garment, opened with folded panels, variant with openings in the semi-lateral seam at the bottom of the seat, with view of the vertical position of the baby and view of the side panels which is fixed at front to maintain the opening. Partial view of right side panel as it is the reflection of the left side.

FIG. 21) shows a front and flat view of the closed garment on the left and open on the right, variant with support yoke at the bottom and openings that gives access to the baby, into semi-lateral seam, under the seat.

FIG. 22) shows a flat view of the inside of the garment, open and folded-back panels, variant with support yoke at the bottom and with openings into semi-lateral seam at the bottom of the seat, with view of the vertical position of the baby and view of the side panels which is fixed at the front and on the yoke to maintain the opening. Partial view of the right side as it is the reflection of the left side.

FIG. 23) shows a semi-profile front view of closed and attached garment, with a baby inside, on a "small size" person on the left and on a "large size" person on the right, with variant external swivel shoulder strap, sewn into the semi-lateral seam.

FIG. 24) shows a semi-profile front view of closed and attached garment, with a baby inside, on a "small size" person on the left and on a "large size" person on the right, with variant inner swivel shoulder strap, sewn into the semi-lateral seam.

FIG. 25) shows a flat inside view of a variant of the garment, opened, unattached.

FIG. 26) shows a flat front view of a variant of the garment of FIG. 25), closed and attached FIG. 27) shows a back and flat view of the garment of FIGS. 25) and 28), closed and attached FIG. 28) shows a flat front view of a variant of the garment, closed and attached FIG. 29) shows a flat back view of a garment variant, closed and attached FIG. 30) shows a flat front view of a variant of the garment, closed and attached at the front, with detached shoulder straps.

FIG. 31) is a flat view of the back of a variant of the garment of FIG. 30), closed and attached, shoulder straps attached FIG. 32) shows a flat inside view of a variant of the garment, opened, unattached.

FIG. 33) shows a front and flat view of a closed and attached garment variant, with partially detached shoulder strap FIG. 34) is a flat back view of a variant of the garment of FIG. 33), closed and attached.

FIG. 35) shows a front and flat view of a dosed and attached garment variant.

FIG. 36) shows a back and flat view of a variant of the garment of FIG. 35), partially closed and detached.

FIG. 37) shows a flat inside view of a variant of the garment, opened, unattached.

FIG. 38) shows the instructions for installing the garment on a person, with sequential view.

FIG. 39) shows the instructions for installing the baby into garment, on a person, with sequential view.

DETAILED DESCRIPTION OF THE PREFERRED EMBODIMENTS

As seen in FIGS. 1), 2) and 3), the invention is a garment, more specifically a bodice in the drawing, which can carry skin-to-skin a small baby up to about 5 kg, in a safe, comfortable, hand-free way, with good support over a long period of time, thanks to the wide and pivoting shoulder straps (C) and the seamless inner seat (U) inside the front panel (B), retained by a semi-lateral or lateral vertical seam (T). Shirring (W) of the front panel are recommended but optional, they may be absent if wanting the front of the garment being less curved, so more upright support of the back of the baby.

This shirring (W) can also be lower on the semi-lateral seam (T), for example to give more ease to the belly (not shown) or from top to bottom, making the entire length of the semi-lateral or lateral vertical seam (T).

The garment is "one size", thanks to its adjustable side panels (A) which cross at the back (FIGS. 4) and 5)) and are attached to the front by a simple knot (F).

The semi-lateral support seams (T) and the fold fabric for neck support ((Y), in FIG. 7)) at the top of the front panel (B) are inspired by the model "Bodice Support for Skin-to-skin, Canadian patent #2,825,577, by the same inventor.

This garment is made of a lightweight, slightly stretchy, comfortable and easy-care fabric, such as cotton, bamboo rayon, Tencel™, Modal™, viscose, polyester/cotton blend jersey, polyester/viscose, brushed polyester, and other similar fibers, with little or no stretch fiber such as spandex, thus easy to obtain and inexpensive fabrics. Manufacturing can be done at low cost, which is an important asset for humanitarian use.

In order to provide more insulation to the front panel (B) and thus not let the heat of the newborn escape, the use of a fluffy fabric such as polyester micro-fiber fleece or other type of fleece is recommended. However, the lighter fabric should be kept on side panels (A) to keep wearer comfortable.

As seen in FIGS. 4), 5), 6) and 7), to keep garment well fitted and comfortable, the shoulder strap (C) is retained in front in the semi-lateral seam (T) which serves as pivot to fold the strap from one side to the other, depending on the size of the user.

The front panel (B), as seen in detail in FIG. 3) is folded inward (E) and then folded again (U) to form the support of baby's back and inner seat. This front panel is also retained by the semi-lateral seams (T). It can be of variable length and width.

A restraining seam (D) may be added at the seat to hold the baby vertically and/or to prevent sagging of the edge of the seat when the fabric used is very flexible.

Breastfeeding easily (FIG. 8)) is also essential for KMC (Kangaroo Mother Care), which includes skin-to-skin and breastfeeding. The edge of the front panel (E) can be easily lowered between the semi-lateral seams (T) to free the breast, while keeping the garment in place.

The pivoting shoulder strap (C) can be attached at different height along the semi-lateral seam (T) and can be of different width, as seen in FIGS. 23) and 24). It can even be fixed all along the semi-lateral seam (T), down to the bottom of the garment. It can be double thickness of fabric or single thickness, flat or with pleats at the semi-lateral seam (T) to widen the shoulder strap or with a folded edge (J) as seen in FIGS. 9), 13) and 15), to provide additional support for the baby's neck and head in a semi-vertical or horizontal position, as seen in FIGS. 9), 10) and 11). Just open the edge of shoulder strap (J) to slide baby's head in.

The shoulder strap (C) can be joined to the semi-lateral seam (T) on the outside, as seen in FIGS. 1) to 15), or on the inside, as seen in FIGS. 16), 17), 19), 20) and 24).

Positioning the baby: the vertical position, as seen in FIG. 12), is recommended by neonatal specialists but this garment allows different positions of the baby, as needed. In the case of a caesarean or because there is a large abdominal discomfort of the parent carrier, baby can be placed higher, in a horizontal position with the upper body raised, commonly called "cradle position", as long as baby's airways are always clear. The front knot of crossed side panels (A) should be raised to support better, as seen in FIG. 10). It is thus also possible to fold the bottom of the garment over the abdomen (G), as seen in FIGS. 11) and 14), to clear the belly.

As seen in FIG. 15), the shoulder strap can be detachable and adjustable along its length by adding snaps (H), by the unit or by sewn tape on the garment, in non-metallic material preferably, applied along the semi-lateral seam (T).

Use: can adjusts the length of the strap to the size of the wearer, detaches the shoulder strap to facilitate breastfeeding or to pass the arm of the parent who would be with intravenous tubing.

It is possible to replace the snaps with buttons and buttonholes (not shown).

As seen in FIGS. 16), 17) and 18), the front panel can also be detachable, using snaps (K), affixed directly to the garment or on a tape sewn to the garment, non-metallic material preferably (to avoid contamination of heavy metals), along the semi-lateral seam (T).

For medical use: to give quick and easy access to the baby without lowering the front panel or to pass medical tubing. Another use: to breastfeed more discreetly.

The snaps may be affixed to the outside of the shoulder strap (FIGS. 16) and 17)) or inside the shoulder strap (FIG. 18), along the semi-lateral seam (T).

It is easier to use, more comfortable and less expensive to stop the opening with snaps at the bottom of the seat (U) of the front panel (B) but it is possible to lower the opening with snaps down to the bottom of the garment for a fuller opening.

It is possible to replace the snaps with buttons and buttonholes or Velcro™ strips.

To access the baby without lowering the front panel (B) and without having to use the openings with snaps, it is also possible to make openings (L) in the semi-lateral seam (T). To prevent these openings from loosening the support of the garment, it is important that the side panels (A) are joined at the front, inside the garment, as seen in FIG. 20). It is also possible to create a yoke or band at the bottom to support the side panels (A) at the opening (L).

Medical use: have access to the baby for vital signs. Another use: to get baby's legs out when he gets bigger.

As seen in FIGS. 25), 26), the front panel (B) of the garment can be made narrower to support smaller babies (less than 2 kg). The semi-lateral seam (T) being closer to the center front, the straps (C) will also be closer to the center front. The seat (U) inside the front panel will be slightly higher.

For all these garment variants, the knot fastening of the side panels (A) crossed at the back (FIG. 27) and attached to the front can be replaced by other types of fasteners to obtain the same adjustment, such as the Velcro strips (V) horizontally (FIGS. 25) and 26)), by hooks and eyelets or by the side panels passed in two "D" rings (FIG. 28)). The garment can also be adjusted at the back only, with velcro strips (V), as seen in FIG. 29).

Swivel shoulder straps are important for optimal support but use of the bodice variant with the support of the front panel with halter strap (FIGS. 30), 31) 32), or strapless (FIGS. 35), 36) 37)) is easier for people with reduced mobility or people who are having intravenous tubing and offers good support if it is well adjusted horizontally.

The halter strap may be one-piece (FIG. 32) or detachable (FIGS. 30) and 31)) and may also have the same fabric fold to hold baby's head (J) as for the shoulder strap.

As seen in FIGS. 33) 34), 35) 36), the garment can cover lower at the front and at the back by using a double and adjustable backing strap (M) with Velcro™ (V), snaps or hook and eye, adjustable on several levels.

FIG. 38) shows the installation instructions of the adjustable garment with side panels (A) to tie at the front, on a person, with sequential view. In the first picture (N), the parent enter arms into shoulder straps, side panels (A) to tie on each side. In the second picture (O), the parent crosses the sides panels (A) in the back and back to the front. In the third picture (P), the parent tightens the sides and makes a solid knot.

FIG. 39) shows the instructions for installing the baby in the garment with swivel shoulder straps, on a person, with sequential view. In the first image (Q), the parent lowers the shoulder straps slightly (C) and lowers the side panels (A), the knot (F) and the front panel (B). In the second image (R), the parent slides the baby down in foetal position (curled up), skin against skin, inside the front panel, putting his buttocks into inner seat. In the third image (S), the parent raises the shoulder straps (C), raises the front panel (B) and raises the knot in front (F). Readjust to the desired height (baby's head "at kissable height") and tighten the knot if necessary. Stretch and lift the fabric around the neck to support the bottom of baby's head and neck, while ensuring that baby's airways are always clear.

Information regarding the recommended physiological position of a skin-to-skin neonate for the Kangaroo Method, upright on the parent's torso, which maximizes health benefits (as recommended by Dr. Susan Ludington United States Institute of Kangaroo Care at the KMC Certification Course):

1) Naked baby (in diaper), belly and back extended, face to face with completely naked torso of the parent, the head of the baby at the height of the parent's clavicle, between the two breasts. Baby must be able to move a little so the support must be flexible.
2) Natural position of infant baby, ie upright or slightly upright position, curled-seated, back slightly curved forward, legs forming an "M", knees bent upwards to approximately navel height, bent elbows and forearms raised on the torso of the parent, spine in the center (not curved to the left or right), head in the axis of the column, chin raised midway up, respiratory tract unobstructed, nose close to the parent's skin to smell her.

The invention claimed is:

1. A device for carrying a baby allowing a direct skin-to-skin contact with a wearer, the device comprising a front panel having a first portion foldable horizontally on itself about a first fold, and a second portion foldable back on itself about a second fold, the first and second folds being fixed by a retaining seam, so as to form a supple seat for the baby without presence of a baby-contacting seam located at the level of buttocks and thighs pressure points that can irritate skin of the baby.

2. A device for carrying a baby, as defined in claim 1, characterized by the front panel having a double thickness about the first fold and has a triple thickness about the second fold.

3. A device for carrying a baby, as defined in claim 1, characterized by the retaining seam is a vertical seam.

4. A device for carrying a baby, as defined in claim 1, characterized by the retaining seam is semi-lateral on torso of the wearer.

5. A device for carrying a baby, as defined in claim 1, characterized by the first portion, in double thickness, is a support on the back of the baby, without a baby-contacting seam that can irritate the skin of the baby at the neck of the baby.

6. A device for carrying a baby, as defined in claim 1, further comprising a shoulder strap joined to the retaining seam.

7. A device for carrying a baby, as defined in claim 1, further comprising a shoulder strap joined or partially integrated to the retaining seam, said retaining seam being positioned vertically on torso of the wearer and said shoulder strap being swivelable and reversible on an axis defined by the retaining seam up to top of a shoulder of the wearer, which can then be tipped to a side of the neck of the wearer or to an outer side of the shoulder of the wearer, whichever is most comfortable or best suited to body type of the wearer.

8. A device for carrying a baby, as defined in claim 1, further comprising at least one side panel joined to the retaining seam, which can be tensioned and adjusted to different levels according to morphology of the wearer, said side panel having at least one adjustable fastening device and detachable at its end.

9. A device for carrying a baby, as defined in claim 1, further comprising an additional horizontal fold to a higher level of the front panel than one of the first and second folds, attached to the retaining seam, which opens and rises on nape and bottom of the head of the baby.

10. A device for carrying a baby, as defined in claim 1, characterized by the front panel includes shirring from the retaining seam giving curvature to the front panel.

11. A device for carrying a baby, as defined in claim 1, characterized by the front panel includes one or more snap(s), allowing complete or partial opening of the front panel at one or more level(s).

12. A device for carrying a baby, as defined in claim 1, characterized by the front panel has one or more button(s) and buttonhole(s) allowing full or partly opening of the front panel at one or more level(s).

13. A device for carrying a baby, as defined in claim 1, characterized by the front panel includes one or more strip(s) of hook and loop material allowing complete or partial opening of the front panel at one or more level(s).

14. A device for carrying a baby, as defined in claim 1, further comprising a shoulder strap(s) detachable and adjustable by a snap fastener joined to the retaining seam.

15. A device for carrying a baby, as defined in claim 1, further comprising a shoulder strap detachable and adjustable by one or more button(s) and buttonhole(s), joined to the retaining seam.

16. A device for carrying a baby, as defined in claim 1, further comprising a shoulder strap detachable and adjustable by one or more strips of hook and loop material joined to the retaining seam.

17. A device for carrying a baby, as defined in claim 1, characterized by an additional seam fixing the supple seat formed by the folded front panel.

18. A device for carrying a baby, as defined in claim 1, further comprising one or more integrated opening(s) into the retaining seam.

19. A device for carrying a baby, as defined in claim 1, characterized by having the front panel made of a first fabric and the rest of the device made of a second fabric, wherein the first fabric is thicker or more fluffy than the second fabric.

20. A device for carrying a baby, as defined in claim 1, further comprising a shoulder strap pleated or gathered, joined to the retaining seam, with a folded edge that can be opened on the head of the baby in a semi-vertical or horizontal position.

21. A device for carrying a baby, as defined in claim 1, further comprising a lateral panel joined to the retaining seam and comprising ends, the lateral panel being able to be wrapped around the body of the wearer, the ends being crossed at the back of the wearer and attached to the front of the wearer with a removable knot, adjustable at different height levels on belly of the wearer.

22. A device for carrying a baby allowing a direct skin-to-skin contact with a wearer, the device comprising:

a front panel comprising a main portion, a first portion and a second portion, wherein the first portion is foldable on the main portion about a first fold, and the second portion is foldable on the first portion about a second fold, and wherein the first and second folds are fixed by a retaining seam, such that the front panel forms a supple seat for the baby.

* * * * *